United States Patent [19]

Yagasaki et al.

[11] 4,332,462

[45] Jun. 1, 1982

[54] FEED CONTROL DEVICE

[75] Inventors: Toshiaki Yagasaki, Hino; Shunichi Masuda, Tokyo; Katsuichi Shimizu, Kunitachi; Hisashi Sakamaki, Yokohama, all of Japan

[73] Assignee: Canon Kabushiki Kaisha, Tokyo, Japan

[21] Appl. No.: 151,677

[22] Filed: May 20, 1980

[30] Foreign Application Priority Data

May 25, 1979 [JP] Japan ..... 54-64808
May 25, 1979 [JP] Japan ..... 54-64809

[51] Int. Cl.[3] ..... G03G 15/00

[52] U.S. Cl. ..... 355/14 R; 271/258; 271/265; 355/8

[58] Field of Search ..... 355/14 R, 14 SH, 8; 271/259, 258, 265, 275

[56] References Cited

U.S. PATENT DOCUMENTS 3,747,918 7/1973 Margulis et al. ..... 271/275 X
3,948,510 4/1976 Iwamoto et al. ..... 271/258
3,995,953 12/1976 Kawai ..... 271/259 X
4,022,460 5/1977 Pritchett ..... 271/258
4,084,900 4/1978 Yamaoka et al. ..... 271/258 X
4,176,941 12/1979 Breitenkam ..... 271/259 X
4,231,567 11/1980 Ziehm ..... 271/259
4,264,187 4/1981 Rhodes ..... 271/258 X
4,264,188 4/1981 Tomosada et al. ..... 355/14 R

*Primary Examiner*—Richard L. Moses
*Attorney, Agent, or Firm*—Fitzpatrick, Cella, Harper & Scinto

[57] ABSTRACT

A control device is disclosed for controlling the operation of an original document feeder. A detector is provided for detecting the presence of an original at a position along the feed path, and a jam detecting device in coupled to stop the operation of the feeder within a predetermined time period unless the jam detector function is released, in response to said original detector, prior to the expiration of said predetermined time period.

15 Claims, 19 Drawing Figures

FEED CONTROL DEVICE

BACKGROUND OF THE INVENTION

1. Field of the Invention

This invention relates to a device for feeding originals to an exposure station and discharging the same, for example, in a copying apparatus or the like.

2. Description of the Prior Art

In a copying apparatus having the function of feeding and discharging copy mediums such as originals, there have been provided various detector means for controlling the conveyance of the originals to reliably perform said function and prevent breakage of the originals. Further, the breakage of the originals has been prevented by detecting any abnormal conveyance of the originals, effecting jam display and stopping the apparatus from operating.

However, even when a paper jam is not actually taking place, it has sometimes been the case that a jam is displayed and the apparatus is stopped. For example, there are cases where feeding and discharging of originals are effected simultaneously to enhance the speed of original interchange and in such cases, when an original is removed during the paper feeding operation, it has been regarded as unsatisfactory paper conveyance and the apparatus has been stopped with a jam being displayed. However, an original to be discharged is stopped in the course of its discharge in spite of the fact that there is no sign of unsatisfactory discharge. The user is then required to deal with the stopped original when the feeding is re-started.

Also, the apparatus is designed such that when a jam of an original occurs, the drive system of the apparatus is immediately stopped so as to protect the original irrespective of where the jam has occurred and therefore, as described above, it has been impossible to smoothly re-start the copying.

Further, in spite of the lack of an original, the afterlight during the exposure of an original causes detector means to detect an original and permit unnecessary copying operation to take place.

SUMMARY OF THE INVENTION

It is an object of the present invention to eliminate the above-noted disadvantages and to provide a feed control device which judges that an original to be fed has been removed when it is being fed, and thereby releases jam detecting means and refrains from effecting unnecessary control operation.

It is another object of the present invention to provide a feed control device which, even when an original being fed has been removed in the course of its feed, conveys an original to be discharged at a predetermined sequence as long as there occurs no unsatisfactory discharge conveyance, and thereby enables the feeding to be smoothly re-started.

It is still another object of the present invention to provide a feed control device which effects the separation of jam dealing controls during unsatisfactory feed conveyance and unsatisfactory discharge conveyance and thereby facilitates the user's jam dealing procedure and enables the copying to be smoothly re-started after jam.

It is yet still another object of the present invention to provide a feed control device which, in the case of jam during unsatisfactory feed conveyance, stops the feeding operation but continues the discharging operation.

It is a further object of the present invention to provide a feed control device which, when an emergency signal such as stop signal or cut-in signal has been entered, discharges an original and effects jam detection.

It is a further object of the present invention to provide a feed control device which prevents any malfunctioning resulting from the afterlight during the exposure of an original and restrains the apparatus from effecting unnecessary copying operation.

The above and other objects of the present invention will become fully apparent from the following detailed description taken in conjunction with the accompanying drawings.

BRIEF DESCRIPTION OF THE DRAWINGS

FIG. 1-2 is a perspective view of the FIG. 1-1 apparatus.

FIG. 2 is a cross-sectional view of the feeding portion of the bucket portion of ADF.

FIGS. 3-1, 3-2, and 5 diagrammatically shows examples of the feed control circuit according to the present invention.

FIGS. 4-1, 4-2 and 4-3 are operation time charts of the FIG. 3-1 circuit.

FIGS. 7-1, 7-2, 7-3 and 7-4 diagrammatically show examples of the afterlight countermeasure control circuit.

FIGS. 8-1, 8-2, 8-3 and 8-4 are time charts of the circuits of FIG. 7.

DESCRIPTION OF THE PREFERRED EMBODIMENTS

Figure 1:
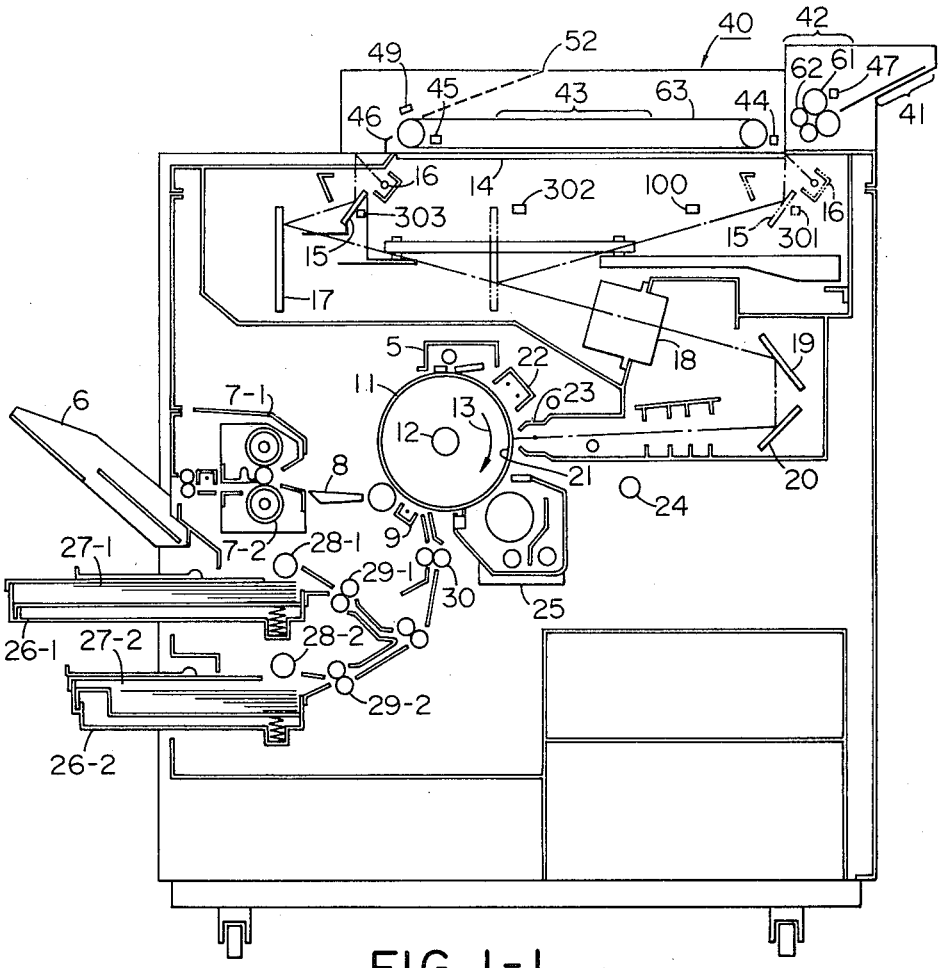
FIG. 1-1 is a cross-sectional view of a copying apparatus to which the present invention is applicable.
Figures 1, 2:
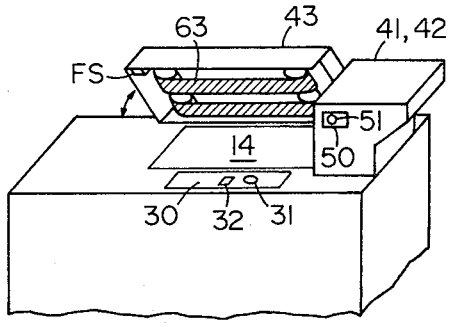
Figure 2:
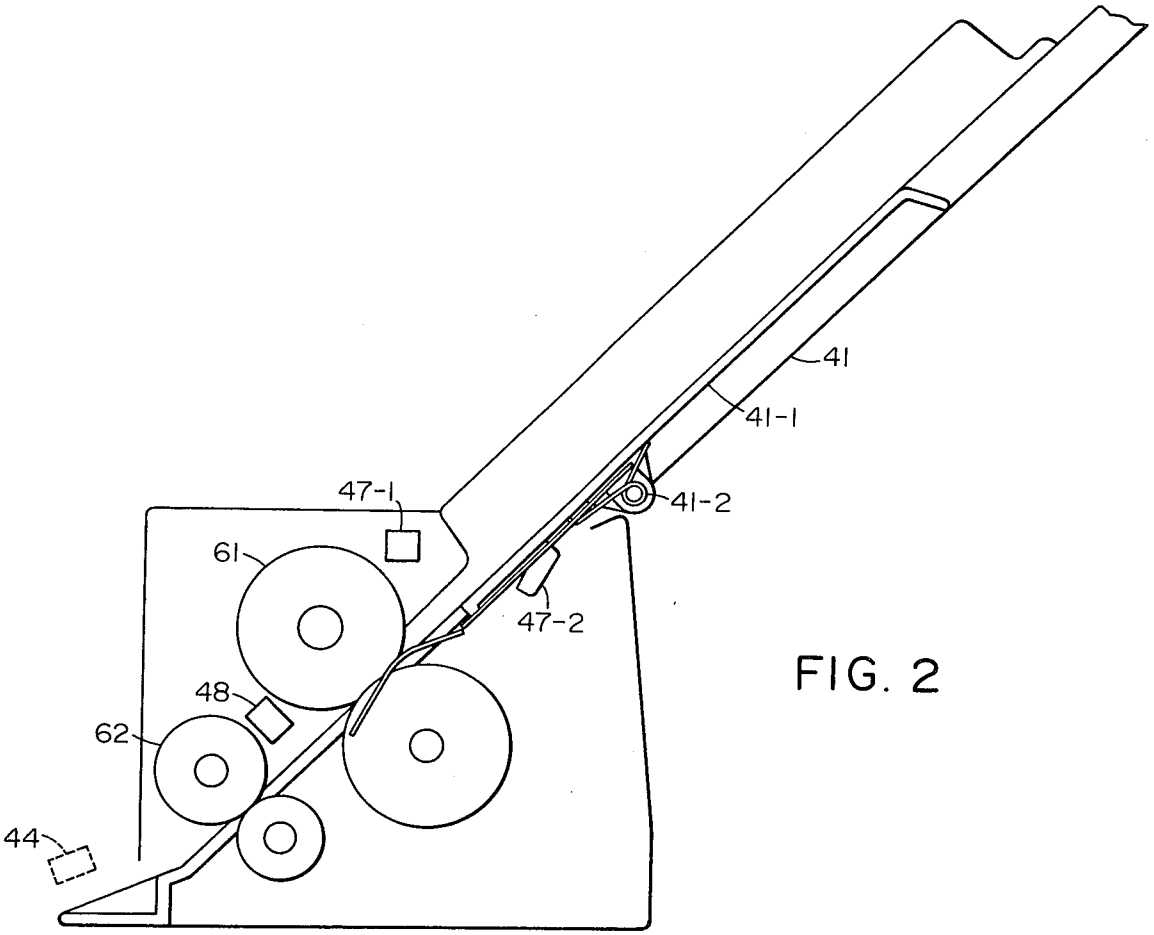

Embodiments of the present invention will hereinafter be described with reference to the drawings. FIG. 1-1 is a cross-sectional view of a variable magnification copying apparatus having an automatic document feeding device (hereinafter referred to as the ADF) to which the present invention is applicable, and FIG. 1-2 is a perspective view of the copying apparatus with the ADF turned.

A drum 11 has, on the surface thereof, a three-layer photosensitive medium using a CdS photoconductive member, and is rotatably supported on a shaft 12 and starts to rotate in the direction of arrow 13 in response to a copy instruction.

When the drum 11 rotates to a predetermined position, an original placed on a platen glass 14 is illuminated by an illuminating lamp 16 formed integrally with a first scanning mirror 15, and the reflected light therefrom is scanned by the first scanning mirror 15 and a second scanning mirror. The first scanning mirror 15 and the second scanning mirror 17 are moved at a velocity ratio of $1:\frac{1}{2}$, whereby scanning of the original is effected with the length of the optical path ahead of a lens 18 which is maintained constant.

The above-mentioned reflected optical image passes through the lens 18 and via a third mirror 19, whereafter it passes via a fourth mirror 20 and is formed on the drum 11 at an exposure station 21.

The drum 11 is charged (for example, to the positive polarity) by a primary charger 22, whereafter at the exposure station 21, it is slit-exposed to the image illuminated by the illuminating lamp 16. Simultaneously therewith, the drum is subjected to AC discharging or discharging of the opposite polarity (for example, the negative polarity) to the primary charge by a discharger 23, whereafter the drum is further subjected to a whole surface exposure by a whole surface exposure lamp 24, whereby an electrostatic latent image of high contrast is formed on the drum 11. The electrostatic latent image on the photosensitive drum 11 is then developed into a visible toner image by a developing device 25.

Transfer paper 27-1 or 27-2 in a cassette 26-1 or 26-2 is fed into the apparatus by a paper feed roller 28-1 or 28-2, and is given approximate timing by first register rollers 29-1 or 29-2, and then given precise timing by second register rollers 30 and transported toward the photosensitive drum 11 so that the leading end of the paper is coincident with the leading end of the toner image on the drum.

Subsequently, the toner image on the drum 11 is transferred to the transfer paper 27 as it passes between an image transfer charger 9 and the drum 11.

After the image transfer has been terminated, the transfer paper is guided onto a conveyor belt 8 and directed thereby to a pair of fixing rollers 7-1 and 7-2, by which the transferred image on the transfer paper is pressed and heated for fixation, whereafter the paper is discharged into a tray 6.

After the image transfer, the drum 11 surface is cleaned by a cleaning device 5 comprising an elastic blade, thus being prepared for the next cycle.

The copying apparatus shown in FIG. 1-1 is capable of forming, on the drum 11, the information on the original placed on the platen glass 14, on a reduced scale. In order that such reduced-scale information may be formed, the position of the lens 18 is changed in accordance with the reduced magnification and also the velocities of the first scanning mirror 15, the lamp 16 and the second scanning mirror 17 are changed in accordance with the reduced magnification, but such a mechanism is already known and therefore need not be described in detail.

Reference numeral 40 designates an automatic original feeding device, reference numeral 41 denotes a sheet bucket portion containing originals therein, reference numeral 42 designates a feeder portion for separating and feeding the originals, reference numeral 43 denotes setting portion for setting an original on the exposure surface 14, and reference numeral 52 denotes a tray for receiving the originals after being used. The ADF 40 is removably mounted with respect to the copier, and the setter portion 43 is openable independently of the portions 41 and 42, as shown in FIG. 1-2.

Operation of the ADF 40 shown in FIGS. 1-1 and 1-2 will be briefly described.

Originals are placed into the bucket portion and the main switches of both the copying apparatus and the ADF are closed, whereafter the auto button 51 of an ADF operating portion 50 is depressed and the copy button 32 of the copying apparatus operating portion 30 is depressed, whereupon the originals are fed toward separating rollers 61 by the operation of the feeder roller 60 of the ADF, and the lowermost original is separated by the separating rollers 61 and passed to register rollers 62. The rollers 62 which are normally stopped are operated for the time required for an original to be fed at a predetermined timing, so that the original is fed under a belt 63 moving round on the original platen 14. The orignal so fed under the belt 63 is transported to a pawl 46 which is lowered in advance at a predetermined timing, and is stopped thereat. The belt 63 is moved round a little further and stopped at a predetermined timing. Until stopped, the belt 63 slides on the original. By this, any oblique position of the original may be corrected. Then, the lamp 16 and mirrors 15, 17 of the copying apparatus start their forward movement to scan the original and a copy is obtained on the transfer paper in the manner described above. When the number of copies set by a dial 31 has been completed, an end signal is supplied to the ADF 40 to raise the pawl 46, and then the belt 63 is again moved round to discharge the original from the platen 14. Simultaneous with this discharging operation, the rollers 61 and 62 are operated to feed the next original toward the belt 63. By this, the copying of the next original can be started early. In the manner described above, the copying is repeated with the originals being successively interchanged.

Reference numerals 44, 45, 47 and 49 in the ADF 40 designate detectors for detecting the presence of originals. The detector 44 is for detecting the jamming of an original at the feeder portion of the separating rollers 61 and register rollers 62, the detector 45 is for detecting jam and erroneous discharge of an original in the setting portion of the belt 63, and the detector 49 is for detecting an original in the discharging portion from the belt 63 to the original discharging tray 52. Each of the detectors 44, 45 and 49 is of the reflection type using a plurality of light-emitting diodes for a light-receiving element. Designated by 47 is a transmission type photodetector for detecting the number of originals remaining in the bucket portion. A reflection type detector 48 is also provided. The belt 63 is grounded to the apparatus body to remove any electrostatic charge developed and accumulated on the belt 63 due to originals being conveyed while being held between the belt and the platen glass.

Also, as shown in FIG. 1-2, the ADF 40 is set so as to be pivotable from one side to the other with respect to the copying apparatus so that the ADF 40 can be spaced apart with respect to the platen 14. The ADF 40 is provided with a switch FS adapted to automatically cut off the power source for controlling the ADF when the ADF 40 is spaced apart. By this, safety is secured so as to prevent the AFD 40 from being operated by closing the ADF main switch SW or depressing the copy button by mistake.

Referring to FIG. 2 which is a cross-sectional view of the bucket portion and feed portion of the ADF 40 in FIGS. 1-1 and 1-2, reference numeral 47-1 designates a lamp for projecting light upon a light-receiving member 47-2, reference numeral 48 denotes a reflection type sensor disposed between the rollers 61 and 62 for detecting an original, reference numeral 41-1 designates a bed for supporting originals thereon, and reference numeral 41-2 denotes a spring for fixing the bed 41-1.

Figures 1, 3:
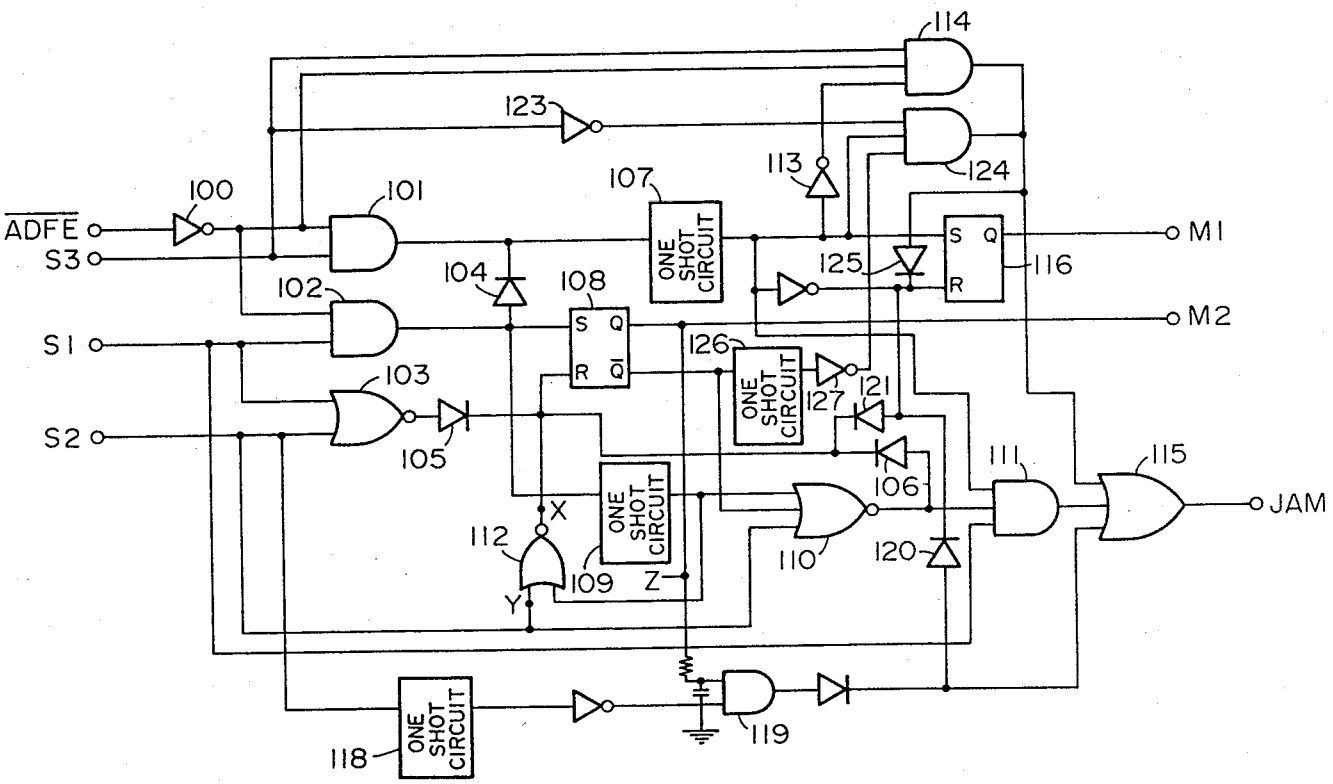
Figures 2, 3:
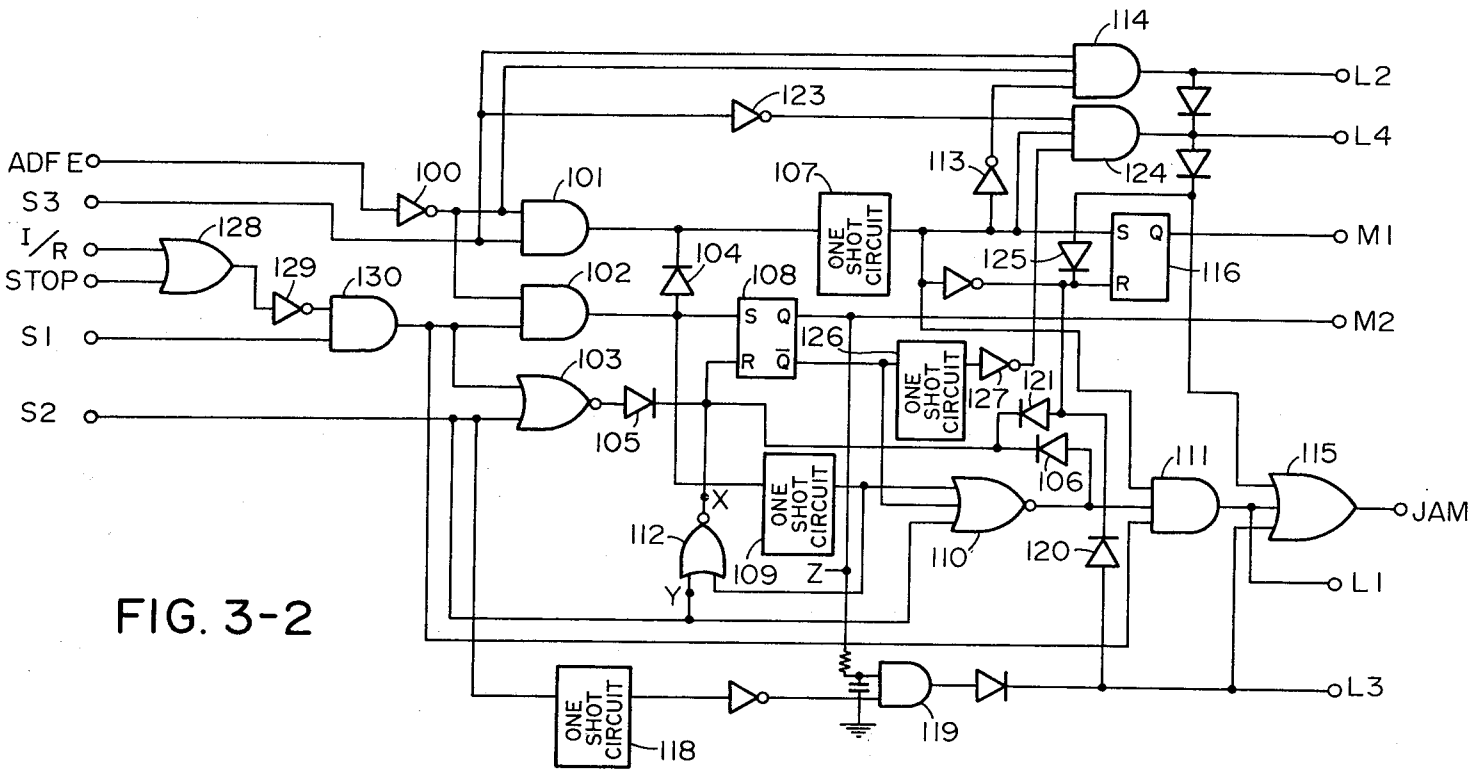
Figures 1, 4:
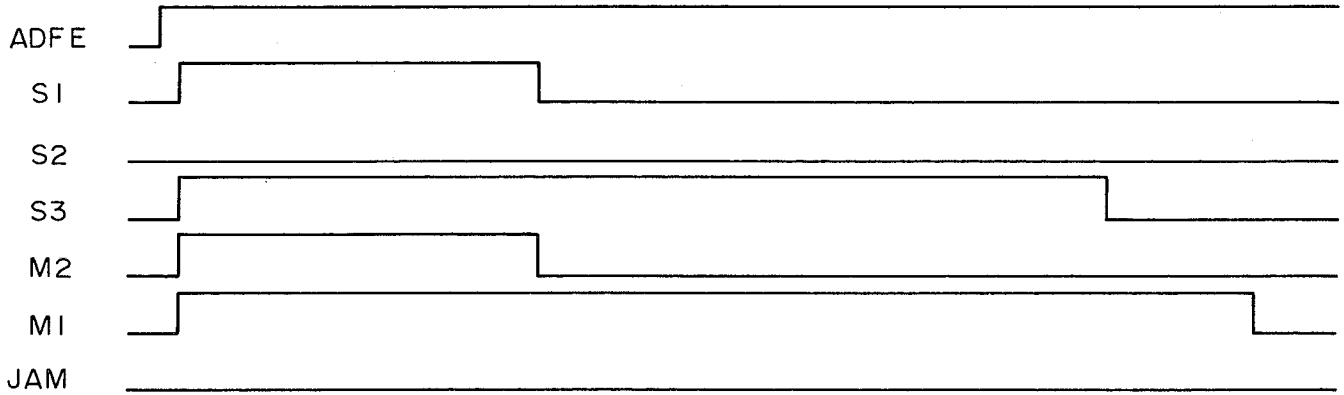
Figures 2, 4:
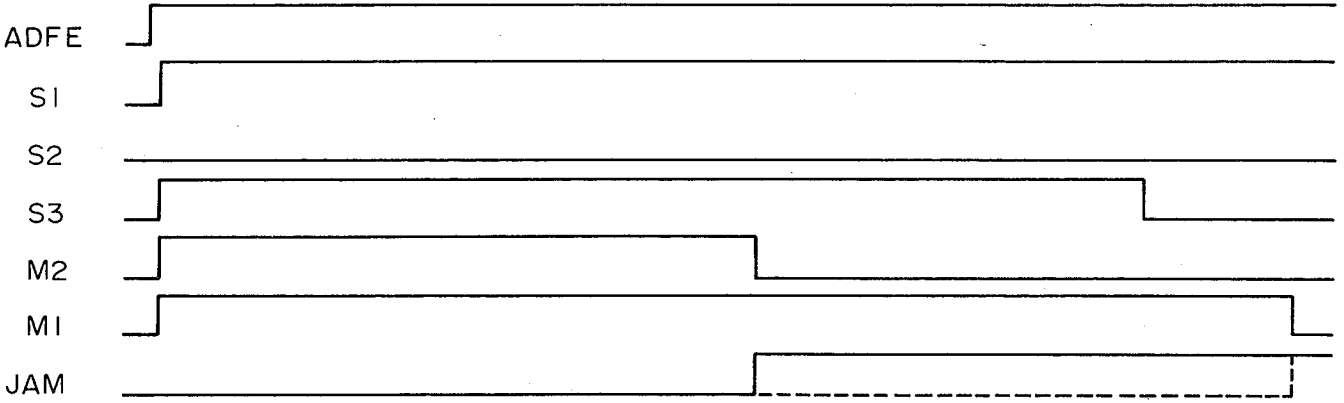
Figures 3, 4:
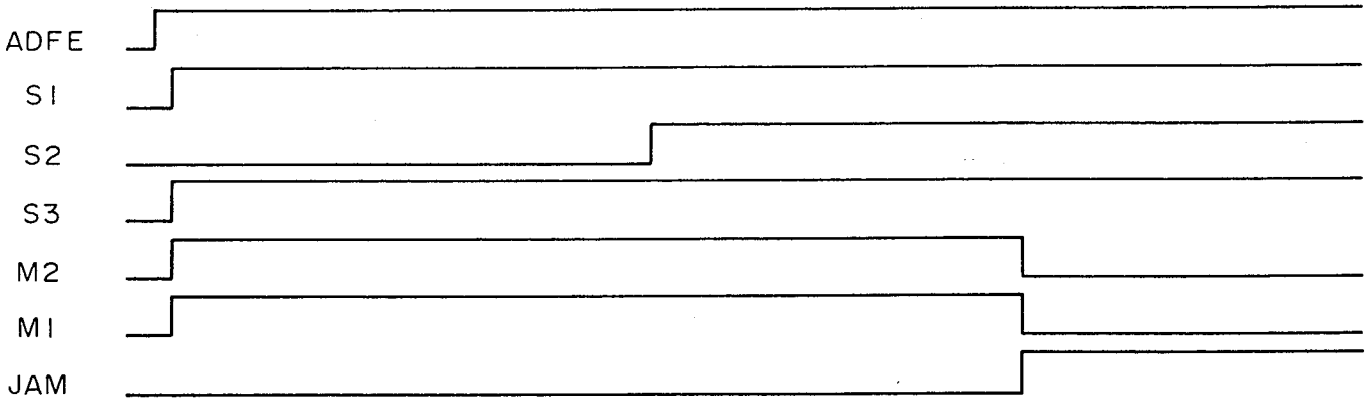

FIG. 3 shows an example of the feed control circuit in the present invention, and FIGS. 4-1 and 4-2 are operation time charts thereof. In FIG. 3, reference numerals 107 and 117 designate a one shot circuit and a flip-flop, respectively, for energizing a first motor M1 for driving the belt 63, reference numeral 108 designates a flip-flop for energizing a second motor M2 for driving the feed rollers 61 and 62, and reference numeral 109 denotes a one shot circuit for detecting the jamming of an original. The one shot circuits 107 and 109 are one shot multivibrators which provide timers, and the former one shot circuit 107 becomes OFF after the time required for an original to be set on the setting portion, and the latter one shot circuit 109 becomes OFF after a time required for an original to arrive at the feed sensor. The flip-flop 108 is such that the Q and $\overline{Q}$ terminals thereof become 1 and 0, respectively, for the pulse to the terminal thereof and the $\overline{Q}$ and Q terminals thereof become 1 and 0, respectively, for the pulse to the R terminal thereof. Designated by 111, 114 and 115 are AND gates and an OR gate for energizing a jam displayer. Denoted by 101 and 102 are AND gates for controlling the motors M1 and M2. Reference numeral 103 designates a NOR gate for controlling the motor M2, reference numeral 110 denotes a NOR gate for controlling the displayer and motor M2, reference numeral 112 designates a NOR gate for deenergizing the motor M2, reference numerals 100 and 113 denote inverters, reference numerals 104 and 105 designate one-directional diodes, and ADFE is an ADF start signal put out when the set number of copies have been completed or when the last scan has been terminated and the scanning means is reversed in movement. The signal ADFE is also put out by a key instructing the possibility of operation. Also, where the stop key, cut-in key, etc. have been depressed on the apparatus body side, the signal ADFE is put out when the scan at that point of time has been terminated and the scanning means is reversed in movement. It is to be understood that the signal ADFE ceases when M1 and M2 are OFF. S3 is a signal which becomes 1 during the time that the discharge check sensor 45 is detecting an original, S1 is a signal which becomes 1 during the time that the bucket sensor 47 is detecting an original, S2 is a signal which becomes 1 during the time that the post sensor 44 is detecting an original, and JAM is a signal for setting an unshown circuit for turning on and off a jam lamp. The bar signal of the ADF means reversal of the level of the signal ADFE.

If the ADF key is depressed when originals are contained in the bucket portion, the flip-flop 108 is set by the signals ADFE and S1 through the gate 102 to operate the feed rollers 61 and 62, which thus separate and start to feed the lowermost original from the bucket. Simultaneously therewith, the one shot circuit 107 is energized through a diode 104 to operate the motor M1, which thus starts to drive the belt. Also, as regards the original already set on the setting portion, when the preset number of copies have been completed, the belt and feed rollers are driven by the signal ADFE and the discharge sensor signal S3 (which means the presence of an original in the setter portion) through the gates 101 and 102, thereby interchanging the original.

The output $\theta$ put out when the flip-flop 108 is set at the time of start is delayed by an RC circuit and applied to the AND gate 119. The delay time determined by this RC is at least equal to the time during which an original is fed to actuate the sensor 44 and accordingly, at this point of time, the one shot circuit 118 is energized. Thus, the output of the AND gate becomes 0 with the result that a jam signal is not put out.

The one shot circuit 109 is the jam timer which is set through the gate 102 and starts the jam check operation by the post sensor 44. When the fed original arrives at the sensor 44 within the timer time of this one shot circuit 109, the output of the gate 110 is 0 due to the signal S2 being 1 even if the time of the one shot circuit 109 is up, and the output of the jam outputting gate 111 does not become 1. Accordingly, the jam display signal JAM is not set.

However, where the signal S2 does not become 1 before the time of the one shot circuit 109 is up, the gate 110 puts out 1 because it receives as input the signal 0 from the flip-flop 108, the signal 0 of the one shot circuit 109 and 0 of the signal S2, and the gate 111 to which the belt signal M1 is applied becomes 1, thus producing a JAM output. At the same time, the flip-flop 108 is reset through the diode 106 to stop the motor M2 of the feed rollers.

The belt is not stopped unless the flip-flop 116 is reset after the lapse of the timer time of the one shot circuit 107 or with the setting jam, and therefore, the original being discharged can be discharged completely out of the machine.

In cases other than jamming, when an original passes the feed sensor 44 and its trailing end reaches that sensor, the signal S2 changes from 1 to 0. Upon this change, 0 is applied to both inputs of the gate 112, which thus puts out 1 to reset the flip-flop 108 and accordingly deenergizes the feed roller motor M2. The gate 110 receives 1 from the flip-flop 108 and thus, it does not produce a jam output. Thereafter, the original is conveyed on the platen by the belt 63 and set thereon and strikes against a stop 46. For a short time, the belt is moved, but is stopped after the time set by the one shot circuit 107. Then, a copy start signal is put out to the copier side to start the exposure scanning.

When oblique movement of an original is found during its feed in the feed portion and such original has been removed with the originals in the bucket portion to prevent further oblique movement of the original, the signals S1 and S2 become 0. Accordingly, the output of the gate 103 becomes 1 to reset the flip-flop 108 and deenergize the motor M2, thus stopping the feed rollers from rotating. However, the flip-flop 116 for the belt motor M1 is not reset and so, the belt continues to move to cause the copied original on the platen to be completely discharged. When originals are again set in the bucket portion, the feeding flip-flop is set through the gate 102 because the signal ADFE has already been latched, and thus the feeding operation is effected.

Description will now be made of a jam occurring when an original has arrived at the post sensor 44 but could not pass such sensor. When the leading end of the original is detected by the post sensor 44, the one shot circuit 118 which puts out 0 after at least the time required for the original to pass the sensor 44 is energized. If the trailing end of the original is detected during that time, the gate 119 puts out 0, but if not, the gate 119 puts out 1 to effect display through the gate 115. At the same time, the flip-flop 116 is reset through the diode 120 to deenergize the motor M1 and stop the belt motor, and the flip-flop 108 is reset through the diode 121 to deenergize the motor M2 and stop the feed roller motor. Thus, the feeding is immediately stopped to prevent the original from being destroyed.

When a jam has occurred on the platen leading to the discharge sensor 45 and the arrival of an original has been delayed, the gate 124 acts to effect the jam display. That is, the one shot circuit 126 is set by the OFF timing of the motor M2, and an original is properly moved after the trailing end thereof has passed the sensor 44, and the timer operation for rendering the signal from 1 to 0 takes place after the time required for the original to actuate the sensor 45. When the diode 121 has become 0, the gate 124 applies 1 by the inverter 127. If the signal S3 is then 1 by the discharge sensor, the gate 124 puts out 0 by the inverter 123 and does not effect the jam display, but when the signal S3 is 0, the output of the gate 124 becomes 1 and this gate puts out the signal JAM through 115. At the same time, the flip-flop 116 is reset through the diode 125 to deenergize the belt motor.

Also, to detect jam during discharge of an original, the signal of the sensor 45 is checked at the timing for deenergizing the belt motor M1. That is, when the output of the one shot circuit 107 is 1 by the diode 113 and when the signal S3 is 0, the apparatus is regarded as normal, and when the signal S3 is 1, the original has not yet been discharged and in such case, therefore, the apparatus is regarded as abnormal and the jam display is effected. At this time, the motors M1 and M2 have already been stopped and thus, the process involved is to the start of copying on the copier side.

In this manner, the various sensors on the platen monitor the conveyance of originals and this leads to minimized destruction of the originals, and moreover, jam dealing is distinctively effected to provide smooth re-start of the ADF.

By making the discharge check timing of the discharge sensor 45 correspond to the time when the stop 46 is lowered, it is also possible to effect a jam check by the use of the lowering signal of such stop. At the same time, it is also possible to compare this signal with the signal S2 of the post sensor 44 and thereby detect any erroneous feed. It is also possible to effect the triggering of the delay checking one shot circuit 121 by the change from 1 to 0 of the feed stagnancy checking one shot circuit 118. FIG. 4-1 is a time chart referring to a case where an original has been removed from the feed rollers, FIG. 4-2 is a time chart referring to the case of a feed jam, and FIG. 4-3 is a time chart referring to the case of a feed stagnancy jam. In any of these charts, the ADF is started when originals have been set in the bucket, but the ADF may also be started by the ADF key on the ADF side or the copy button on the copier side.

In the case of the jam detection, jam display is effected at a point in time whereat unsatisfactory paper feed has occurred, but the jam display may also be effected after an original to be discharged has been completely discharged.

Design may also be made such that where an emergency signal of the stop key, the cut-in key or the like has been entered when the copying operation is being effected, the original is discharged after the original scanning has been terminated. The control circuit therefor is shown in FIG. 3-2.

For example, when the stop key or the cut-in key (not shown) is depressed during the production of a plurality of copies, stop signal STOP or cut-in signal IR becomes 1- and 1 is put out from an OR gate 128 and inverted by an inverter 129 and applied to an AND gate 130. Accordingly, even if originals are present in the bucket portion and signal S'3 is 1, the output of the AND gate 130 is 0.

By the depression of the stop key or the cut-in key, signal $\overline{\text{ADFE}}$ becomes 0 at the time when the scanning at the point of time whereat the key has been depressed is reversed. At this point of time, the output signal S'3 of the sensor 45 is 1 and therefore, 1 is put out from the AND gate 101 and the one shot circuit 107 is energized to set the flip-flop 116. By this, the belt 63 starts to be driven and the discharge of the original is effected. However, the inverted signal of signal $\overline{\text{ADFE}}$ is also applied to one terminal of the AND gate 102, but as already described, 0 is applied from the AND gate 130 to the other terminal of the AND gate 102 and thus, the flip-flop 108 is not set and the feed rollers 61 and 62 remain stopped and no original is fed.

When the one shot circuit 107 is deenergized after a predetermined time, the flip-flop 116 is reset and the belt 63 is stopped.

When an original is stagnant at the position of the sensor 45 at this point of time, 1 is put out from the AND gate 114 and jam signal is put out through the OR gate 115.

A jam may also be detected by detecting delayed arrival of the original by the sensor 49.

In the case of the production of a single copy, if the point of time whereat the key has been depressed is before the reversal of the scanning means, that original is discharged and the belt 63 is stopped, but if said point of time is after the reversal of the scanning means, scanning for the next original is effected and the original is discharged and the belt is stopped.

In the case of the depression of the stop key, the number of copies executed or the number of remaining copies to be executed is cancelled, but in the case of the depression of the cut-in key, the number of copies executed is held and after the cut-in, the copying operation is effected for the remaining copies to be executed.

Also, if, as shown, the outputs of AND gates 111, 114, 119 and 124 are taken out and lamps or the like are provided at terminals $L_1$–$L_4$, the position whereat a jam has occurred could also be displayed.

Figure 5:
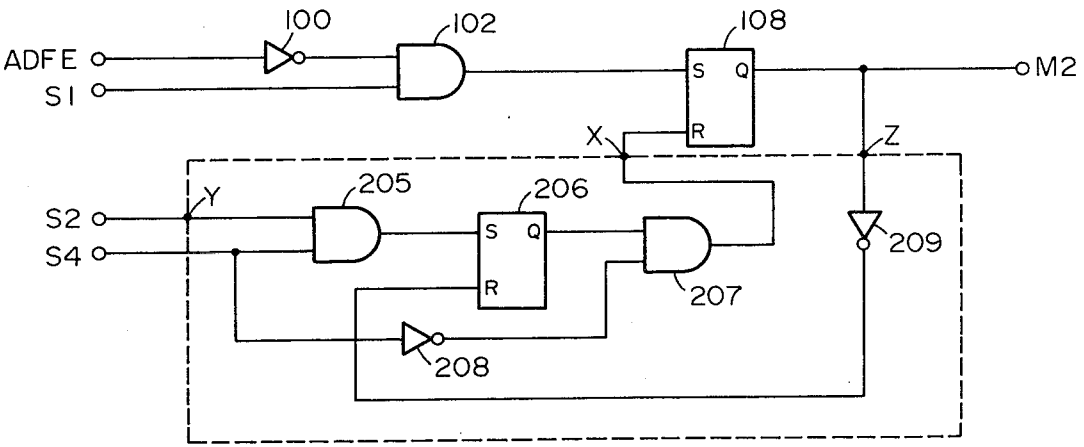
Figure 6:
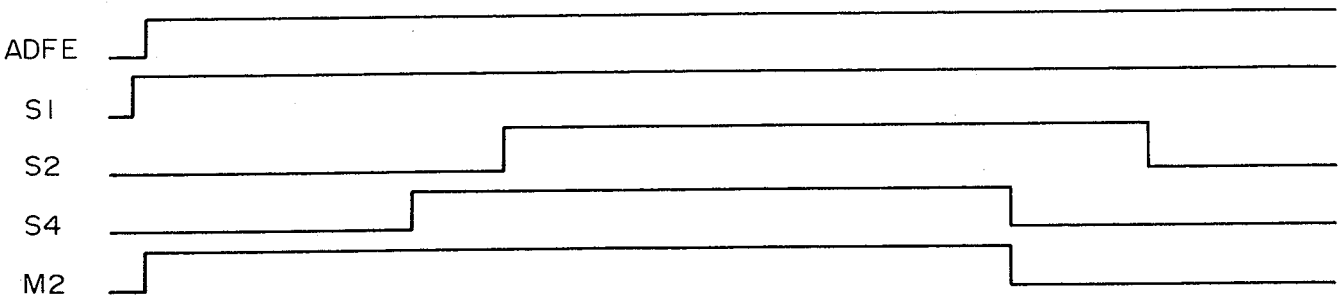
FIG. 6 is an operation time chart of the FIG. 5 circuit.

FIG. 5 shows another example of the feed control circuit in the present invention, and FIG. 6 is an operation time chart of the FIG. 5 circuit. In FIG. 5, reference numeral 206 designates a flip-flop for controlling the feed roller controlling the flip-flop; reference numeral 205 denotes an AND gate for controlling the flip-flop 206; reference numeral 207 designates an AND gate for resetting a flip-flop 204; X, Y and Z are ports connecting to X, Y and Z of FIG. 3 to thereby enable the function of FIG. 5 to be provided in FIG. 3; S4 is a signal which becomes 1 when a reflection type sensor 48 (hereinafter referred to as the presensor) has detected an original; and the other elements are similar to those in FIG. 3.

Operation will now be described. The flip-flop 108 is set by ADF signal and the original signal S1 of the bucket portion to operate the feed roller and start to feed an original. The fed original is detected by the presensor 48 and 1 of S4 is applied to the gate 205. The feeding is continued and the original is detected by the post sensor 44 and 1 of S2 is put out, whereupon the flip-flop 206 is set by the output of the gate 205 and 1 is put out from Q. However, 0 is being applied to the other input of the gate 207 through the inverter 208 and so, the gate 207 does not put out its output and thus does not reset the flip-flop for the feed motor. When the original has passed the presensor 48 and the signal S4 changes from 1 to 0, both inputs of the gate 207 become 1 and the gate 207 puts out 1. Accordingly, the flip-flop 108 is reset to deenergize the feed motor M2. At this time, the original is still present on the feed rollers 62, but even if the driving of the feed rollers 62 is stopped, the rollers 62 try to continue rotating due to their inertia and thus, the remainder of the original can be discharged from the rollers 62 by the remaining rotational force of the rollers 62 and fed into the setting portion. Also, since the feeding force of the rollers 62 is weakened, the original can be smoothly fed along the curved path from the feeder portion to the setting portion. Since the driving of the rollers 62 has been stopped, the next original in the bucket portion is only separated by the rollers 61 and is prevented from being fed through the rollers 62. This roller OFF timing is made to correspond to the time when the second half or trailing end portion of the original passes the rollers 62, as is shown in FIG. 6.

When it is necessary to delay the OFF timing of the separating rollers 61 and feed rollers 62 depending on the length of the feeder portion, the length of the original, the position of the rollers, etc., it can also be controlled by a timer or the like.

The flip-flop 108 is again set by the next ADF signal and the next original is fed by the feed rollers 61 and 62 and, in the manner previously described, the roller motor is deenergized at the time when the feed has not yet been completed. When the original is not driven by the rollers it is held between the belt 63 and the platen 14, and a feeding force is transmitted to that original by the belt which discharges the preceding original. Accordingly, the original is set on the platen by the belt.

Except that the trailing end of the original is detected by the presensor to stop the rollers, it is also possible to measure a predetermined time from the ADFE signal and stop the driving of the rollers 62 at the time when the second half of the original reaches the rollers. It is also possible to stop the driving of the rollers 62 by detecting the leading end of the original by the sensor 44 provided rearward of the rollers 62.

Also, the timing at which the driving of the rollers 62 is stopped in accordance with the angle at which the original is discharged and the weight of the rollers 62 may be controlled by a timer or the like after the original has been detected by the sensor.

The present invention is not restricted to the feeding of originals but is also applicable to the feeding of sheets contained in the cassette 26-1 or 26-2.

Figures 1, 7:
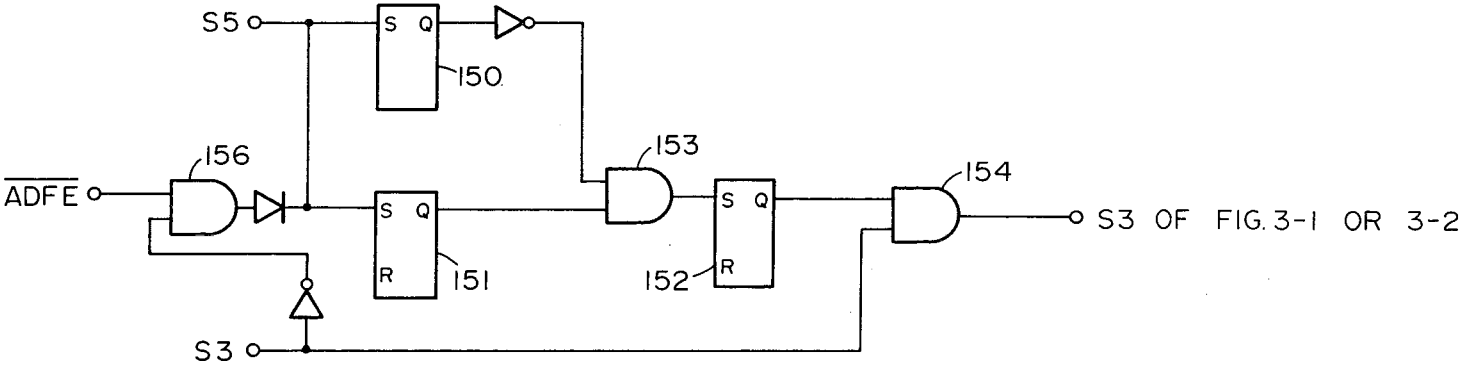
Figures 2, 7:
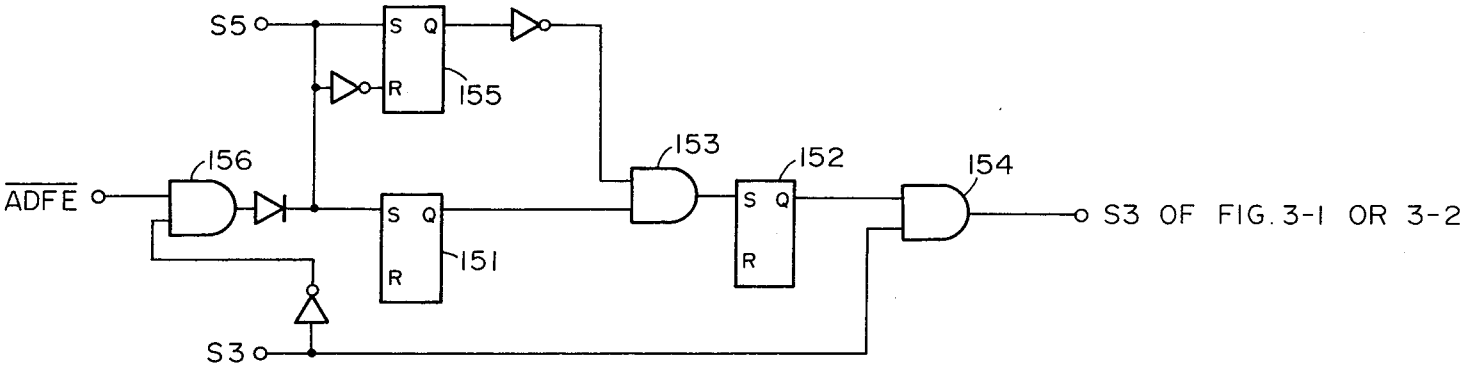
Figures 3, 7:
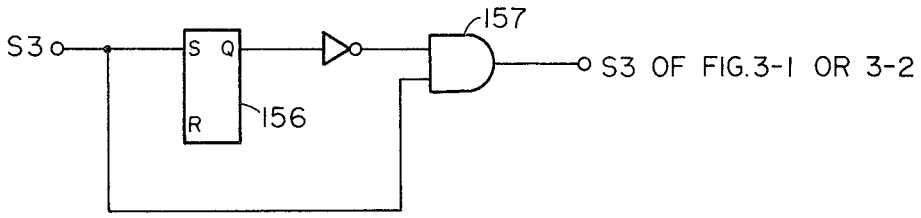
Figures 4, 7:
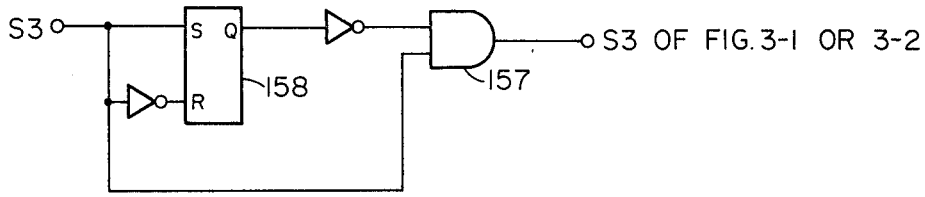

Now, as already described, the sensor 45 is of the reflection type and therefore, it may be operated by the afterlight during the original exposure and, even when an original has not yet arrived at the sensor 45, there may be a case that the sensor 45 detects the original to start the copying operation. It is therefore necessary to make such a design that the apparatus would not malfunction even if the sensor 45 was operated by the afterlight. FIGS. 7-1 to 7-4 show the control circuits therefor.

In FIG. 7, reference numeral 150 designates a one shot circuit which puts out 1 at least during the time that the sensor 49 is ON, reference numeral 151 designates a one shot circuit which puts out 1 at least during the time that the one shot circuit 150 puts out 1, reference numeral 152 denotes a one shot circuit for giving the original detection timing at the sensor 45, reference numeral 153 designates an AND gate for setting the one shot circuit 152, and reference numeral 154 denotes an AND gate which puts out the original detection signal at the sensor 45.

When an original is discharged from the setting portion and the leading end thereof is detected by the sensor 49, S5 becomes 1 and the one shot circuits 150 and 151 are energized. However, since the output of the one shot circuit 150 has been inverted by an inverter, the output of the AND gate 153 is 0. The output of the one shot circuit 150 becomes 0 after the timer time thereof, but at this time the output of the one shot circuit 151 is 1 and therefore, 1 is put out from the AND gate 153 to energize the one shot circuit 153. Within this timer time, detection of the next original is effected and, when the next original has been detected, 1 is put out from the AND gate 154. For example, even if the sensor 45 is operated by afterlight during discharge of an original, as shown in the timing chart of FIG. 8-1, the one shot circuit 152 is not energized because the one shot circuit 130 is energized, and thus the output of the AND gate 154 remains 0. Accordingly, no malfunction occurs due to the afterlight and within the timer time of the one shot circuit 152, the delay check of the next original on the original platen can be effected.

Since the sensor 45 is OFF for the first original, S'3 is 0 and signal $\overline{\text{ADFE}}$ becomes 1, whereby the one shot circuit 151 is set and 1 is put out through the AND gate 153 to set the one shot circuit 152, thus enabling detection of the original to be carried out.

Figures 1, 8:
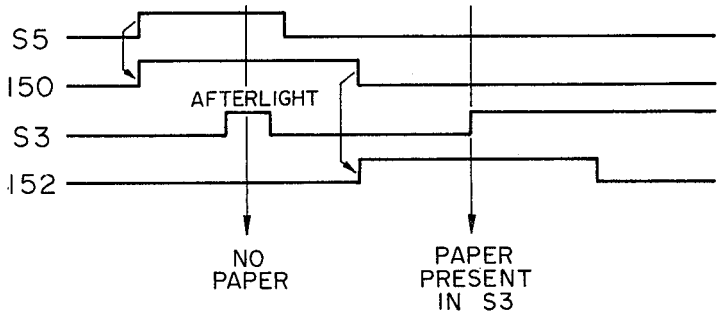
Figures 2, 8:
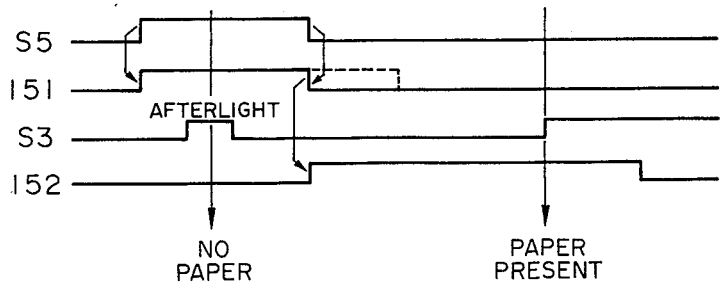
Figures 3, 8:
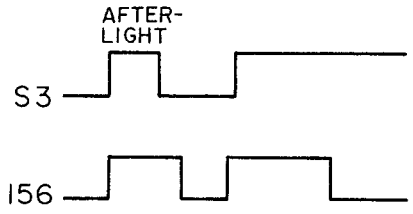
Figures 4, 8:
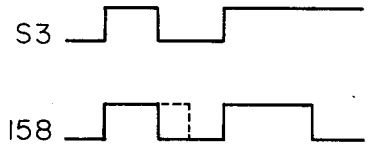

FIG. 7-2 shows another example of the control circuit which is constructed by using a one shot circuit 155 having a reset terminal, instead of the one shot circuit 150. The timing chart corresponding thereto is shown in FIG. 8-2. That is, when the trailing of an original has been detected by the sensor 49, detection of the next original is started. When the sensor 49 becomes OFF upon passage of an original, the flip-flop 155 is reset and the one shot circuit 152 is energized and 1 is applied to one input terminal of the AND gate 154. Accordingly, detection of the next original can be effected without being affected by afterlight.

FIG. 7-3 shows an afterlight countermeasure circuit designed such that the timing for detecting an original is given only by the signal of the sensor 45 at the setting portion, and FIG. 8-3 is a timing chart corresponding thereto. Designated by 156 is a one shot circuit which remains energized at least during the time that the influence of afterlight is present on the sensor 45. Accordingly, even if the sensor 45 becomes OFF within the timer time, such situation is regarded as afterlight because the output of the AND gate 157 remains to be 0, and if the sensor 45 is continuously in its ON state during the OFF of the timer time, 1 is put out from the AND gate 157 and this means that the original has been detected.

FIG. 7-4 shows still another example of the control circuit which employs a one shot circuit 158 having a reset terminal, instead of the one shot circuit 156, and a timing chart corresponding thereto is shown in FIG. 8-4. When the sensor 45 has been operated by afterlight, the one shot circuit 158 is set and the timer operation is started, but before the time is up, the sensor 45 becomes OFF and the one shot circuit 158 is reset and the output of the AND gate 157 is 0. However, when the sensor 45 becomes ON upon detection of an original, the one shot circuit 158 is set to start the timer operation and when the time is up, 1 is put out from the AND gate 157 because the sensor 45 is in its ON state, and thus detection of the original can be effected to start the copying operation.

Figure 9:
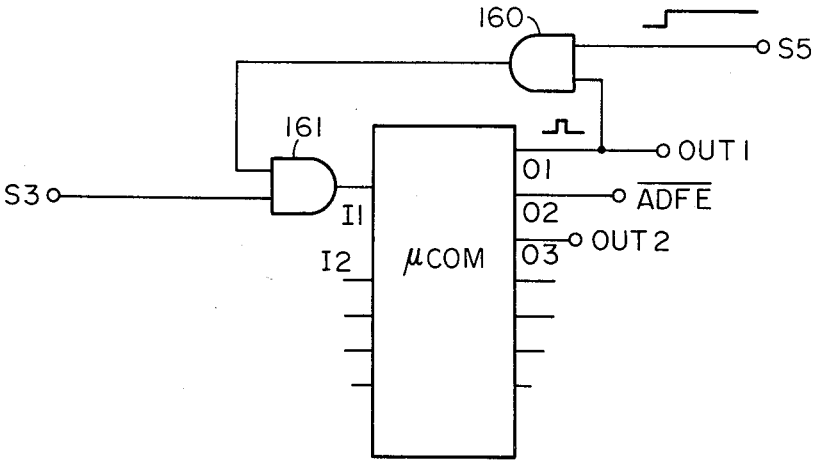
FIG. 9 diagrammatically shows an afterlight countermeasure control circuit using a microcomputer.

FIG. 9 shows an example of the case where the above-described control is effected by a microcomputer. Designated by μCOM is a microcomputer having a program memory ROM and a data memory RAM. A strobe signal is periodically put out from the output terminal $\theta_1$ of the microcomputer and is applied to one terminal of an AND gate 160. The microcomputer is programmed so that the strobe signal is not put out as long as there is afterlight. When the sensor 49 becomes ON, S5 becomes 1 and 1 is put out from the AND gate 160 at the time when the strobe signal is put out, and it is applied to one terminal of an AND gate 161. When an original is detected by the sensor 45, 1 is put out from the AND gate 161 and applied to the input port $I_1$, and stored in the RAM within the $\mu$COM, whereby control of the apparatus is effected. The gate 160 may be provided as required.

As described above, even if the sensor 45 becomes ON by afterlight, it does not provide an original detection signal and thus, unnecessary copying operation does not take place.

What we claim is:

1. A copying apparatus comprising means for feeding originals;

means for exposing a fed original to light to copy said original;

optical detector means for detecting said original and for providing an output signal to control the copying operation; and means for controlling the output signal from said detector means in response to a predetermined time signal to prevent the detector signal from being influenced by light from said exposure means which reaches said detector means.

2. A copying apparatus according to claim 1, wherein said predetermined time signal is a timer output.

3. A copying apparatus according to claim 1, wherein said predetermined time signal is a timing signal during the copying operation.

4. A feed control device comprising means for feeding originals along a feed path to a predetermined position, means for detecting an original provided in the feed path, jam detecting means for stopping said feeding means when said original detecting means does not detect said original within a predetermined time, and means for releasing the operation of said jam detecting means in response to a signal from said original detector means when said original is detected as having been removed from the feed path within said predetermined time.

5. A feed control device according to claim 4, wherein said feeding means comprises means for discharging an original at said predetermined position when another original being fed has been removed in the course of its feed.

6. A feed control device according to claim 4, wherein the removal of a said original is detected by first detector means for detecting the presence of an original at an upstream side with respect to said predetermined position, second detector means for detecting an original at a downstream side on said feed path, and a timer for counting time required for operation wherein the original feeding is started, said original is normally conveyed, and said original is detected by said second detector means.

7. A feed control device according to claim 6, wherein the removal of a said original is detected at the time when said first and second detector means detect that said original is absent on the feed path within said predetermined time.

8. A feed control device according to claim 6, further comprising:

means for detecting the jam of an original in the discharge conveyance path of said placement means, and means for preventing the start of copying in response to a jam detection.

9. A feed control device comprising:

a sheet storage portion for holding originals therein;

feeder means for separating and feeding said originals from said storage portion; and placement means for setting said originals at an exposure position and for discharging said originals from said exposure position;

means for detecting the presence of originals at said feeder means; and means for stopping said feeder means and for continuing operation of said placement means when said detecting means does not detect the presence of an original within a predetermined time.

10. A feed control device comprising:

means for discharging originals from an exposure position;

means for applying a signal for causing a copying operation to stop before a plural set number of copies have been completed;

operation control means for operatively controlling said discharging means in response to said signal; and means for detecting a jam of originals discharged by said discharging means and for displaying an indication of said jam.

11. A feed control device according to claim 10, wherein said discharging means operation is started after the scanning of an original and after said signal is applied.

12. A feed control device according to claim 10, wherein said applied signal is a stop signal or a cut-in signal.

13. A feed control device according to claim 10, wherein said operation control means effects the operation control to prevent the feeding of the next original.

14. A feed control device comprising:

means for feeding originals to an exposure position;

means for scanning the originals at said exposure position;

detecting means for detecting the presence of an original provided at said exposure position;

operation control means for sensing the presence of an original provided at said exposure position at a predetermined time when a set number of times of copying the sensed original scan has been terminated and the scanning means is reversed in movement, to control the start of the next copying operation.

15. A feed control device according to claim 14, wherein said detecting means is a reflection type sensor.

* * * * *